United States Patent [19]

Kano et al.

[11] 4,450,100

[45] May 22, 1984

[54] PASTE FOR FORMING TRANSPARENT CONDUCTIVE COATING FILM

[75] Inventors: Mitsuru Kano; Yoshimi Kamijyo, both of Furukawa, Japan

[73] Assignee: Alps Electric Co., Ltd., Japan

[21] Appl. No.: 431,322

[22] Filed: Sep. 30, 1982

[30] Foreign Application Priority Data

Nov. 25, 1981 [JP] Japan ..... 56-188887

[51] Int. Cl.[3] ..... H01B 1/06

[52] U.S. Cl. ..... 252/518; 252/500; 106/311

[58] Field of Search ..... 252/518, 500; 106/1.22, 106/311

[56] References Cited

U.S. PATENT DOCUMENTS 4,303,554 12/1981 Sudo et al. ..... 252/518

*Primary Examiner*—Josephine Barr

*Attorney, Agent, or Firm*—Guy W. Shoup; Henry T. Burke

[57] ABSTRACT

A paste for forming a transparent conductive coating film which is composed of an indium compound as a principal ingredient, a tin compound for resistance adjustment, nitrocellulose as a thickener, and a mixed solvent of butyl cellosolve, butyl carbitol, benzyl acetate, and dimethyl phthalate. This paste has a long life and improved workability in screen printing and provides a coating film superior in transparency and bond strength.

1 Claim, No Drawings

PASTE FOR FORMING TRANSPARENT CONDUCTIVE COATING FILM

BACKGROUND OF THE INVENTION (1) Field of the Invention

The present invention relates to a paste for forming a transparent conductivce coating film of metal oxide form on glass and other substrates by screen printing and baking.

(2) Description of the Prior Art

It is known that a coating film of an oxide of Cd, In, Sn, etc. formed on glass and ceramic substrates is transparent and highly conductive. On account of this property, it is used for semiconductor devices, liquid crystal display units, window deicing conductive film, etc., and its potential uses are expanding. Such transparent conductive films are made of metal oxide are formed by chemical spray, vacuum deposition, or screen printing processes.

The chemical spray process is advantageous for forming a coating film of comparatively large area, but is disadvantageous in that it requires an additional etching step for complicated configurations. The vacuum deposition process does not need etching owing to the recently developed mask deposition process, but is not suitable for mass production because it is carried out batchwise. The screen printing process is free of these disadvantages; it is advantageous in that any configuration can be formed by printing and baking and it does not give off liquid waste resulting from etching. Nevertheless, the screen printing process has been poor in workability because the paste for forming transparent conductive coatings is poor in stability, and the coating films formed by this process are not uniform in conductivity.

Heretofore, the paste was composed mainly of organic acid indium salt such as indium octylate $[(C_7H_{15}CO_2)_3In)]$ having a strong ionic bond. This compound, however, is susceptible to hydrolysis and promotes gelation of paste when made into a paste. This chemical instability shortens the life of paste and impairs the workability of screen printing. In addition, the resulting coating film has a comparatively high resistance and a low strength because the paste contains ethyl cellulose as a binder which is excessively heat-resistant (e.g., it does not burn completely at 500° C.). In order to overcome these disadvantages, the present inventors successfully used an organic indium complex such as trisacetylacetonatoindium (III) $[In(acac)_3]$ with acetylacetone (Hacac) coordinated therein as a compound forming metal oxide film on baking, and an organic tin complex such as dimethyltin acetylacetonate $[(CH_3)_2Sn(acac)_2]$ as a tin compound for resistance adjustment to improve the paste stability. Moreover, the present inventors have found that the adhesion of coating film is improved and the resistance of coating film is lowered if nitrocellulose is used as a thickener. However, a nitrocellulose-containing paste is shorter in life and poorer in printing workability as compared with an ethylcellulose-containing paste. It has now been found that these drawbacks are alleviated to a considerable extent by using deacidified nitrocellulose.

SUMMARY OF THE INVENTION

It is an object of the present invention to provide a paste for forming a transparent conductive coating film, the paste having a long life and good printing workability, and the coating film having low resistance, good transparency, and high bond strength.

The present invention is characterized in that cellosolve and carbitol are used or ketone for dissolving nitrocellulose in the paste, so that the squeezee for screen printing, which is usually made of urethane rubber, the swelling which is caused by ester or ketone solvents. The swollen squeezee aggravates printing performance.

DESCRIPTION OF THE PREFERRED EMBODIMENTS

According to the present invention, the solvent for nitrocellulose is a mixture of butyl cellosolve, butyl carbitol, benzyl acetate, and dimethyl phthalate. This mixed solvent attacks the sqeezee very little and prevents the paste from gelling.

The following non-limiting examples are given by way of illustration only.

EXAMPLE

Pastes of the following compositions were prepared from $In(acac)_3$ as an indium compound, $(CH_3)_2Sn(acac)_2$ as a tin compound for resistance adjustment, deacidified nitrocellulose H80M (a product of Taihei Chemical Company) as a thickener, and a mixed solvent of different combination.

| | |
|---|---|
| Metal portion | 4 wt % |
| $In(acac)_3$ | 3.48 wt % |
| $(CH_3)_2Sn(acac)_2$ | 0.52 wt % |
| Thickener | X wt % (13 to 17 wt %) |
| Solvent | (96 − X) wt % |

The pastes thus prepared were evaluated by how many shots they could provide in screen printing until plate clogging or blurring occurred. The screen used was a 250 mesh stainless steel net having a 10 μm thick resist. The results are shown in Table 1.

TABLE 1

| No. | Solvent (Ratio) | No. of printing shots | Causes for stopping printing |
|---|---|---|---|
| 1 | BAC:BA:DMP (6:2:2) | 60 | Blurring, (clogging) |
| 2 | C | 60 | Blurring, (precipitate) |
| 3 | BS | 20 | Clogging |
| 4 | BC | 60 | Blurring, (precipitate) |
| 5 | C:BAC (9:1) | 75 | Blurring |
| 6 | BC:BAC (8:2) | 75 | (Blurring) |
| 7 | BS:C:BAC (3:5:2) | 60 | Blurring |
| 8 | BS:C:BAC (5:3:2) | 20 | Blurring, clogging |
| 9 | BS:DMP (8:2) | 20 | Clogging |
| 10 | BC:BAC:DMP (6:2:2) | 90 | (Blurring) |
| 11 | BC:BS:BAC:DMP (4:3:2:1) | 150 | (Blurring) |
| 12 | BC:BS:BAC:DMP (4:2:2:1) | 210 | (Blurring) |
| 13 | BC:BS:BAC:DMP (4:2:2:2) | 240 | (Blurring) |

Note:
BA: Benzyl alcohol
BAC: Benzyl acetate
C: Carbitol
BS: Butyl cellosolve
BC: Butyl carbitol
DMP: Dimethyl phthalate It is to be noted that the best result was obtained with the pastes containing a 4-component mixed solvent of butyl cellosolve, butyl carbitol, benzyl acetate, and dimethyl phthalate.

Coating films obtained from the paste of this invention are identical in performance with those obtained from the conventional paste.

What is claimed is:

1. A paste for forming a transparent conductive coating film comprising $In(acac)_3$, $(CH_3)_2SN(acac)_2$, about 13 to 17 weight percent of deacidified nitrocellulose, and a solvent consisting essentially of the following components in the weight percents indicated:

Butyl carbitol . . . 40 to 44
Butyl cellosolve . . . 20 to 30
Butyl acetate . . . 20 to 22
Dimethyl phthalate . . . 10 to 22.

* * * * *